US010723118B2

(12) United States Patent
Arici

(10) Patent No.: US 10,723,118 B2
(45) Date of Patent: Jul. 28, 2020

(54) SYSTEM AND METHOD FOR OVERPRINTING ON FLEXIBLE SUPPORT ON REEL WITH CAPABILITY OF RELIEF PRINTING

(71) Applicant: ROTOPRINT SOVRASTAMPA S.R.L., Lainate, Milan (IT)

(72) Inventor: Gian Carlo Arici, Milan (IT)

(73) Assignee: ROTOPRINT SOVRASTAMPA S.R.L., Lainate, Milan (IT)

( * ) Notice: Subject to any disclaimer, the term of this patent is extended or adjusted under 35 U.S.C. 154(b) by 0 days.

(21) Appl. No.: 15/028,378

(22) PCT Filed: Oct. 11, 2013

(86) PCT No.: PCT/IT2013/000283
§ 371 (c)(1),
(2) Date: Apr. 8, 2016

(87) PCT Pub. No.: WO2015/052738
PCT Pub. Date: Apr. 16, 2015

(65) Prior Publication Data

US 2016/0257111 A1 Sep. 8, 2016

(51) Int. Cl.
*B41F 21/00* (2006.01)
*B41F 19/02* (2006.01)
(Continued)

(52) U.S. Cl.
CPC ..... *B41F 21/00* (2013.01); *B41F 5/24* (2013.01); *B41F 13/0045* (2013.01);
(Continued)

(58) Field of Classification Search
None
See application file for complete search history.

(56) References Cited

U.S. PATENT DOCUMENTS 2,118,816 A * 5/1938 Lamatsch ..... B41F 13/68 226/31
2011/0168042 A1* 7/2011 Guaraldi ..... B41F 13/025 101/228

FOREIGN PATENT DOCUMENTS

EP 2343186 A1 7/2011
EP 2436518 A2 4/2012
(Continued)

OTHER PUBLICATIONS

PCT International Search Report for counterpart PCT Application No. PCT/IT2013/000283, 4 pages, (dated Jul. 31, 2014).

*Primary Examiner* — Joshua D Zimmerman
(74) *Attorney, Agent, or Firm* — Womble Bond Dickinson (US) LLP

(57) ABSTRACT

A system and method for the overprint on flexible supports are described. In particular, the overprint system 1 comprises a printing unit 2 comprising a rotatable printing cylinder 3, having printing zones at the surface thereof, and first actuating means 14, configured to drive in a controllable manner the printing cylinder 3 rotation. The system further comprises a first reel 5 for unwinding a flexible support 4 to be printed, which has preset zones to be overprinted, and a second reel 8 for rewinding the flexible support 4, once it has been printed. A plurality of winding rolls 7 arranges an unwinding path, for the flexible support 4, comprised between the first 5 and the second 8 reels, and passing through the printing unit 2. The system then comprises second actuation means 20, configured to drive in a controllable manner the flexible support 4 advancement along the unwinding path (upstream of the printing unit 2 in the unwinding direction), and control means 10, configured to control in a coordinated manner both the first actuating means 14 and the second actuation means 20, so as to determine at every moment a correspondence of the preset
(Continued)

zones to be overprinted of the flexible support 4 with respective printing zones of the printing cylinder 3.

19 Claims, 3 Drawing Sheets

(51) Int. Cl.

| | |
|---|---|
| ***B41F 19/00*** | (2006.01) |
| ***B41F 13/14*** | (2006.01) |
| ***B41F 13/004*** | (2006.01) |
| ***B65H 23/188*** | (2006.01) |
| ***B41F 13/02*** | (2006.01) |
| ***B41F 17/00*** | (2006.01) |
| ***B41F 33/00*** | (2006.01) |
| ***B41F 5/24*** | (2006.01) |
| ***B41M 1/04*** | (2006.01) |
| ***B41M 1/24*** | (2006.01) |

(52) U.S. Cl.
CPC ..... *B41F 13/025* (2013.01); *B41F 13/14* (2013.01); *B41F 17/00* (2013.01); *B41F 19/00* (2013.01); *B41F 19/02* (2013.01); *B41F 33/0081* (2013.01); *B41M 1/04* (2013.01); *B41M 1/24* (2013.01); *B65H 23/1882* (2013.01); *B41P 2213/90* (2013.01); *B41P 2217/11* (2013.01); *B65H 2513/42* (2013.01); *B65H 2801/21* (2013.01)

(56) References Cited

FOREIGN PATENT DOCUMENTS

| | | |
|---|---|---|
| FR | 2369934 A1 | 6/1978 |
| FR | 2461669 A1 | 2/1981 |
| IT | 1249030 B | 2/1995 |

* cited by examiner

SYSTEM AND METHOD FOR OVERPRINTING ON FLEXIBLE SUPPORT ON REEL WITH CAPABILITY OF RELIEF PRINTING

CROSS-REFERENCE TO RELATED APPLICATION

This patent application is a U.S. National Phase Application under 35 U.S.C. § 371 of International Application No. PCT/IT2013/000283, filed Oct. 11, 2013, entitled SYSTEM AND METHOD FOR OVERPRINTING ON FLEXIBLE SUPPORT ON REEL WITH CAPABILITY OF RELIEF PRINTING.

Field of Application

The present invention relates to the technical field of overprinting on flexible supports. In particular, the invention relates to an overprint system and a corresponding overprint method having such requirements as to allow recycling printable flexible supports, by overprinting in preset positions, and with a capability to print also in relief.

Description of the Prior Art

In the so-called "overprint" (or "overprinting") technical field, it is known that it is possible to overprint new characters or figures or colors or other graphics signs on labels or packages or other supports. Such overprint may be useful, for example, to allow recycling and/or re-using already printed labels or packages, creating new ones on a same support.

It is also known that overprinting may be carried out on a support that represents a whole label or package, or only on some desired parts. Furthermore, the overprint may be carried out, where desired, by a cyclic process, which operates in sequence on a plurality of labels or packages.

In this regard, more particularly, it is noticed that the packages or labels or containers of articles and products of a number of commodities sectors can be obtained from reels of flexible materials, such as, for example, paper or multilayer type supports, on the surface of which commercial registered names and/or writings of several types, compositions of the products contained therein, advertising indications, and possibly a number of other information of any nature, are cyclically repeated, on each package or label or container to be obtained.

There is often the need to partially vary only some of the elements printed on the support, for example, the corporate name, the name of the product, or an ingredient list.

If one or more reels of material printed with writings and indications by now obsolete are in stock, it is apparent that there is an advantage in allowing to re-use such reels, thus avoiding the economic loss, which is sometimes also significant, resulting from disposing the obsolete reels.

As already noticed, solutions are known, which allow selectively modifying the printed zones containing messages by now obsolete, which are present on flexible supports, for example, continuous supports wound on a reel. In this manner, such supports can be recovered, thus achieving economic advantages and further contributing to the environmental preservation and energy saving.

However, the known solutions for the overprint have some significant limitations and drawbacks.

First of all, they can be obtained only with certain techniques of printing (for example, rotogravure) and not with other printing techniques. In particular, the known solutions cannot be applied in the context of relief printing techniques, i.e., tridimensional techniques. This is a significant limitation, since it does not allow meeting the need to produce packages or labels with tridimensional graphic signs by overprinting. On the other hand, such need, which has not been met by the prior art, is more and more felt in the considered technical field: notice, just to give an example, the importance to be able to insert the writings also in Braille alphabet, as an advantage to sightless consumers.

Furthermore, it shall be noticed that the types of information set forth on labels or packages are becoming more and more articulated and complex. For example, the bar codes that have to be printed on labels/packages are by now of different type and are becoming more and more developed (notice, for example, the so-called "QR-Codes"), with increasing print accuracy requirements. When it is desired to modify by overprinting some selected parts of a label/package, which parts are particularly complex, or minuscule, or articulated, or refer to a bar code, precision and accuracy requirements arise, which are not met by the currently known overprint systems, machines and processes.

More specifically, the prior art in the considered technical field is not able to meet the requirements imposed by the application fields mentioned above, or it requires systems that had been so rearranged as to have unbearable costs, or it implies unduly complex and slow processes, such that they are not cost-effective.

Therefore, in brief, there is the urgently felt need to significantly extend the applicability of overprinting to the widest possible set of packages or labels, of any complexity, thus allowing benefiting from the numerous advantages achievable through overprinting, such as, for example, the already mentioned ones, relating to the cost-effectiveness, the environmental preservation, and the energy saving allowed by recycling the printable supports.

Such need involves technical requirements that cannot be achieved, with reasonable costs and execution times, by the prior art solutions.

Therefore, such need is to date largely unmet by the known overprint systems and processes.

Therefore, the object of the present invention is to devise and provide an overprint system with such improved requirements of precision, rapidity, reliability and cost-effectiveness as to meet the above-mentioned needs, and which is able to obviate the drawbacks described herein above with reference to the prior art. It is also the object of the present invention to devise and provide an overprint process (i.e., method), which is implemented by the above-mentioned overprint system, which is particularly effective in achieving the mentioned objects.

In particular, the object of the invention is to implement a machine that allows modifying already printed zones of labels or packages, with considerable accuracy and high reliability degree.

It is the object of the invention also to provide the possibility to impress, on packages or labels, letterings in Braille alphabet for sightless people, and to highlight names and marks of the package by the tridimensional effect of a relief.

SUMMARY OF THE INVENTION

Such an object is achieved by an overprint system for overprinting on flexible supports in accordance with claim 1.

Further embodiments of such system are defined in the claims 2 to 16.

An overprint method (i.e., method for overprinting), which employs the above-mentioned system according to the invention, is defined in claim 17.

Further embodiments of such method are defined in the claims 18 to 20.

BRIEF DESCRIPTION OF THE DRAWINGS

Further characteristics and advantages of the system and the method for overprinting according to the invention will be apparent from the description set forth below of preferred implementation examples, given by way of indicative, non-limiting example, with reference to the appended figures, in which.

DETAILED DESCRIPTION

Figure 1:
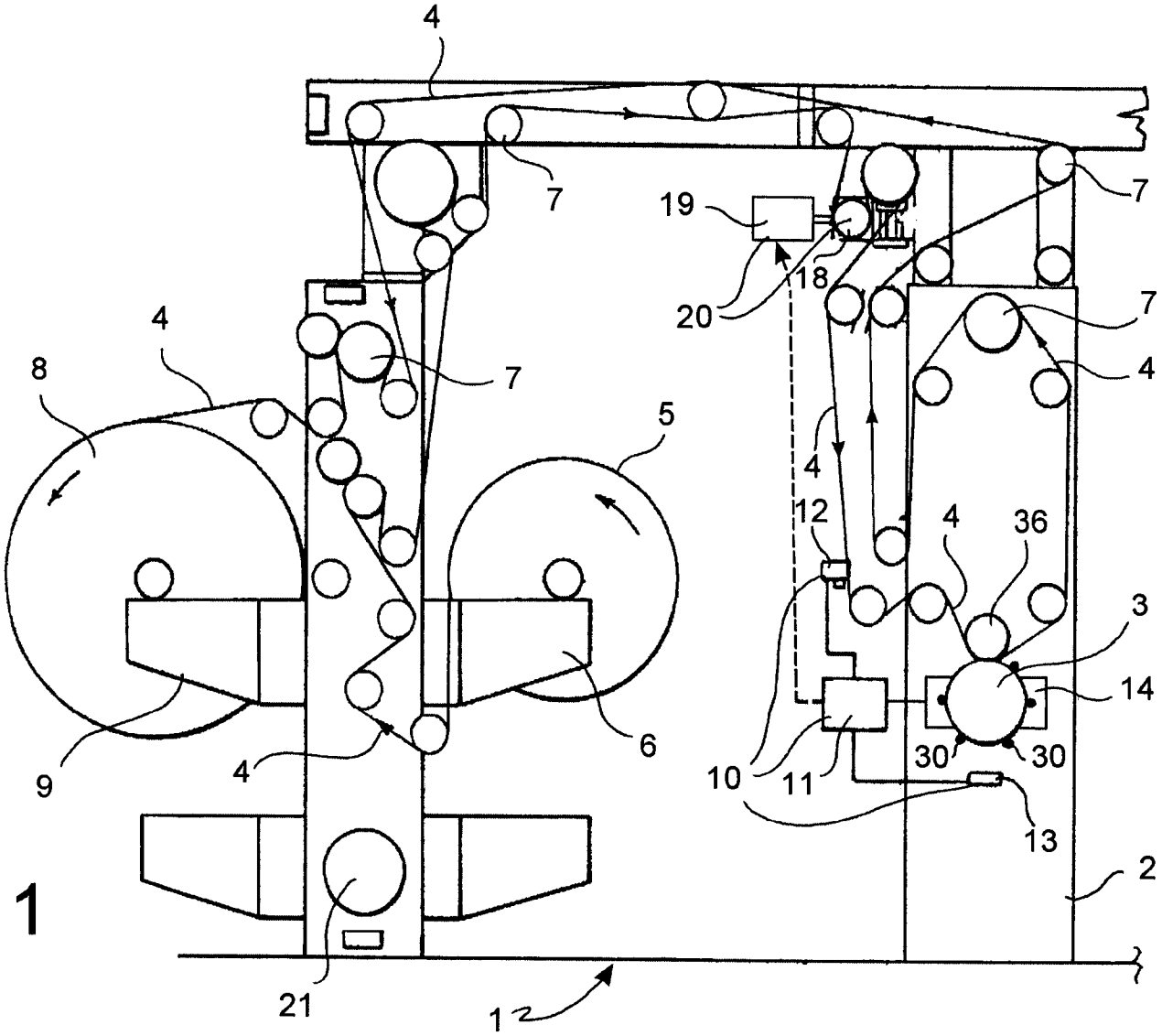
FIGS. 1 and 2 illustrate respective diagrams of the overprint system, according to two implementation examples relating to an embodiment of the present invention, using a relief printing technique.
Figure 2:
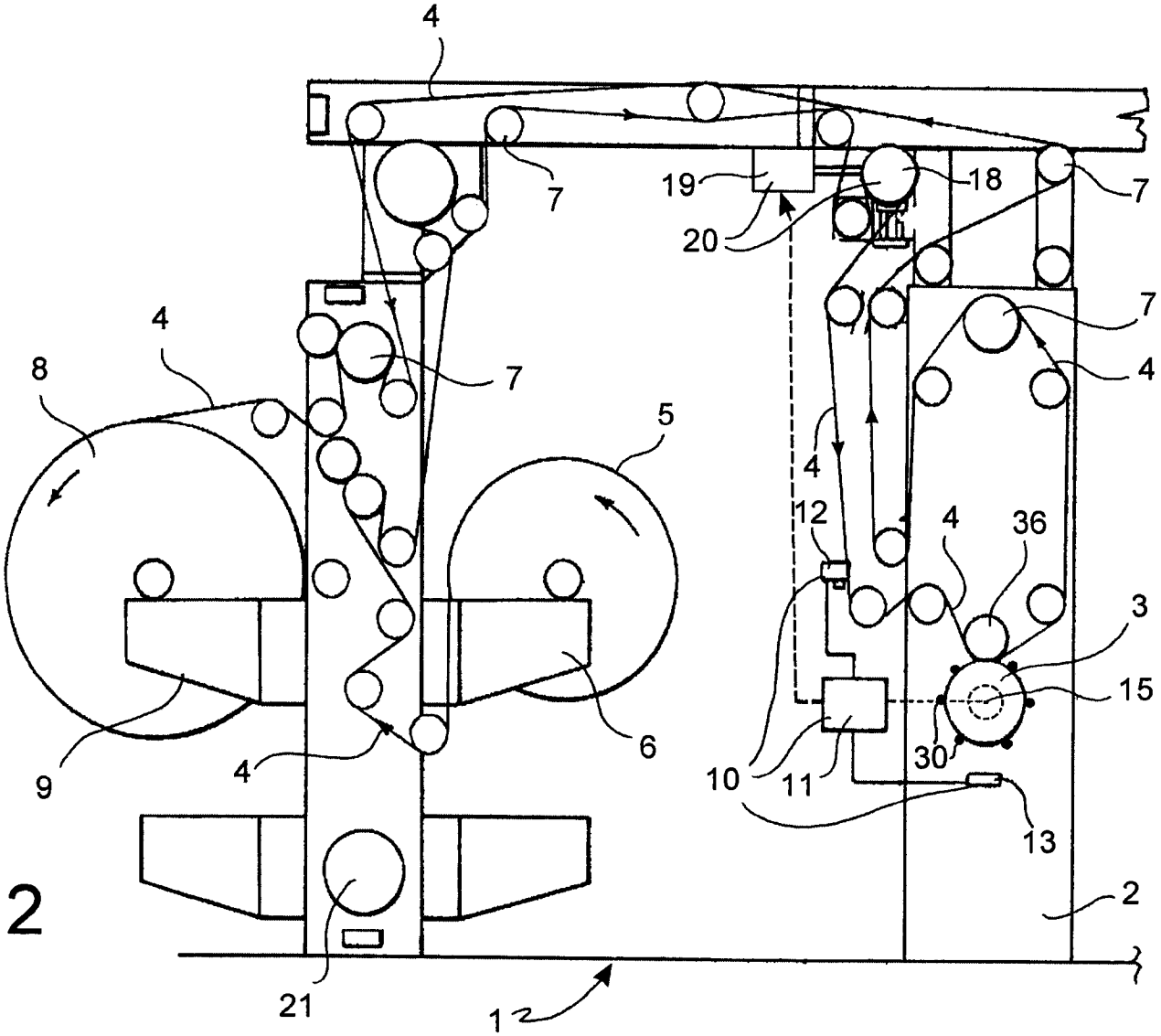
Figure 3:
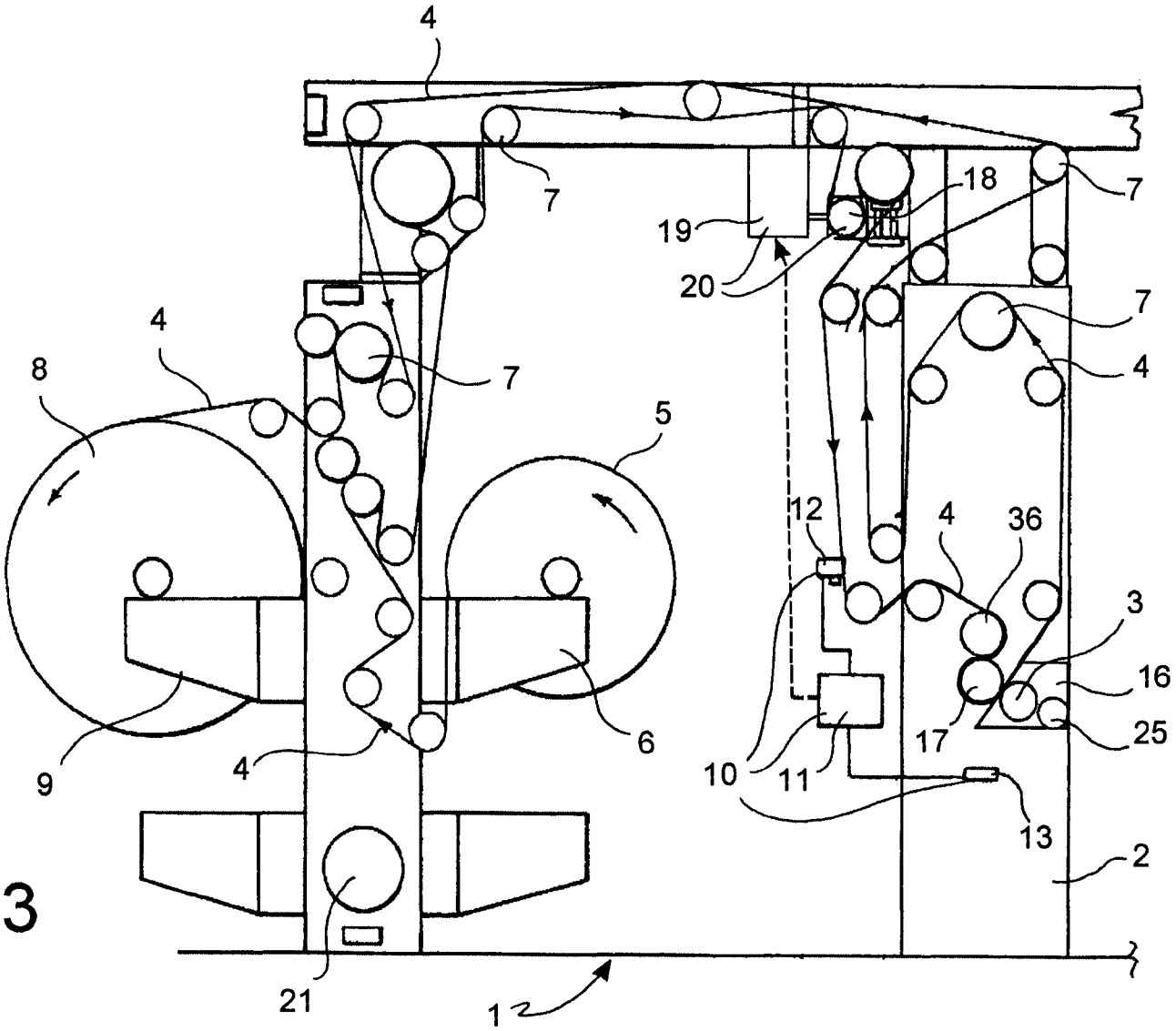
FIG. 3 illustrates a scheme of the overprint system, according to a further embodiment encompassed in the present invention, using a printing technique of the flexographic type.

Respective embodiments of an overprint system for overprinting on flexible supports according to the invention will be now described more in detail with reference to the FIGS. 1, 2, 3.

First, the overprint system 1 for overprinting on flexible supports comprises at least one printing unit 2.

The printing unit 2 comprises, in turn, at least one rotatable printing cylinder 3, having printing zones at the surface thereof, and moreover first actuating means (indicated with the numeral references 14; 15, and 16 in the embodiments illustrated by the FIGS. 1, 2, and 3, respectively), configured to drive in a controllable manner the rotation of the printing cylinder 3.

It is noticed that the printing cylinder 3 is suitable to print according to per se known printing techniques, as it will be detailed herein below.

Referring again to the system 1, it also comprises at least one first reel 5 for unwinding a flexible support 4 to be printed, which has preset zones to be overprinted, and at least one second rewinding reel 8 of such flexible support 4, once it has been printed.

Next, the system 1 comprises a plurality of winding rolls 7, configured to arrange an unwinding path for the flexible support 4, and it further comprises second actuation means 20, configured to drive in a controllable manner the advancement of the flexible support 4 along the unwinding path, upstream of the printing unit 2 in the unwinding direction. In this regard, it shall be noticed that the unwinding path is comprised between the first unwinding reel 5 and the second rewinding reel 8, and it passes through the printing unit 2.

The system 1 further comprises control means 10 configured to control in a coordinated manner both the first actuating means (14 or 15 or 16) and the second actuation means 20, so as to determine at every moment a correspondence of the preset zones to be overprinted of the flexible support 4 with respective printing zones of the printing cylinder 3.

As auxiliary information in order to better understand the invention, it shall be noticed that the flexible support 4 may be any flexible support, for example a paper or multilayer support, suitable to be printed, which may be wound or rollable on a reel.

In a preferred application field, such support is an already printed support, on which the overprint has to be carried out; however, the system of the invention may operate at the same manner for a first print on a new support: in fact, also in this case, the accurate control of the printing zones may be useful, which is ensured by the system of the present invention, in the manner herein described.

Preferably, the flexible support 4 is in the shape on a strip that, for example, extends in a continuous manner in a first direction and that has, in a second direction orthogonal to the first one, a width equal to the width of the unwinding and rewinding reels. Along the continuous extension thereof, in the first direction, the flexible support has a sequence of zones corresponding to respective labels or packages to be printed or overprinted in series, in an equal manner.

In such case, the flexible support 4 may contain a set of configurations and/or writings, in a periodic sequence, which have to be modified in a controllable manner at the preset zones to be overprinted, so as to allow recycling the flexible support.

The preset zones to be overprinted, in different applications made possible by the system, can be the most various: for example, even very small parts of labels or packages that have to be corrected, and on which it is necessary to intervene, for the overprint, with a high spatial accuracy. As discussed above, such preset zones to be overprinted can be pre-printed zones of labels or packages, which have to be modified in a controlled manner to get new labels or packages, thus allowing recycling the flexible support.

However, it shall be noticed that the system according to the invention may operate on flexible supports having also different geometries and configurations compared to those illustrated above.

Details and implementation examples of the already mentioned components of the system 1 will be provided herein below.

The printing unit 2 is suitable to print by means of a contact action between the printing cylinder 3, as it rotates, and the flexible support 4, when, along the unwinding path thereof, it is brought to adhere to the printing cylinder 3.

Advantageously, a nip roll 36 is arranged, in the printing unit 2, on the unwinding path in the proximity of the printing cylinder 3. Such nip roll 36 is suitable to ensure the adhesion, with a suitable contact pressure, between the printing cylinder 3 and the flexible support 4 passing between the nip roll 36 and the printing cylinder 3.

It shall be noticed that, in different implementation examples, encompassed in the invention, in case a multiple color printing is needed, the system 1 may provide for a plurality of printing units 2, one for each of the colors to be transferred onto the flexible support 4.

The above-mentioned first actuating means (14 or 15 or 16) of the printing unit 2 are configured to hasten or to defer the rotation of the printing cylinder 3 relative to the position of the flexible support 4 until to fully compensate positions shifts indicated by the control means 10. Such first actuating means can be obtained by means of one of different types of known motors (i.e., by a "first motor unit"). Herein below, different preferred implementation modes of the first actuating means (14 or 15 or 16) will be described more in detail, with reference to different embodiments of the system.

The unwinding path of the flexible support 4, illustrated by way of example in the appended figure, is determined by the winding rolls 7. Different configurations and arrangements, per se known, of the winding rolls 7 are encompassed in the invention, and result from design criteria of the overprint machine, per se known, relating to operative aspects of such machine that lie outside of the focus of the present invention.

According to an implementation example, the advancement of the flexible support along the unwinding path is determined by a traction exerted by an action of rotatable members. In particular, in the length of the unwinding path comprised between the first reel 5 and the printing cylinder 3, such action may be exerted by the same printing cylinder 3.

In the length of the unwinding path between the printing cylinder 3 and the second rewinding reel 8, such action may be exerted by the rotational rewinding movement of such second reel 8; in addition, a cooperating rotational action driven by one or more of the winding rolls 7 may be optionally provided. In order to initiate the rotation of the second reel 8, according to an implementation example, the system 1 further comprises a second motor unit 21, operatively connected to the second reel 8 to drive the rotation thereof, as described above.

In accordance with a further implementation example, the system 1 also comprises a first support member 6, suitable to support the first reel 5; and a second support member 9, suitable to support the second reel 8. In that case, the second motor unit 21 may be operatively connected to the second support member 9.

According to what has been set forth above, a running direction of the unwinding path is also determined, by the flexible support 4, in relation to which the definition of relative positions, such as the "downstream" or "upstream" positions, makes sense.

Now, it is important to note that the present system 1 is capable of further acting on the normal constant movement of the flexible support 4, described above. In other terms, the system 1 is capable of varying in a controlled manner such movement, establishing controlled "perturbations" thereof.

To such purpose, the second actuation means 20 comprise a compensating roll 18, as shown in the embodiments of the FIGS. 1 and 3 (or a winding compensator 18, as shown in the embodiment of FIG. 2) arranged upstream of the printing unit 2 along the unwinding path, and configured to move forward (i.e., to hasten) or to move backward (i.e., to defer) in a controlled manner the position of the flexible support 4 relative to the printing cylinder 3.

The compensating roll 18 is suitable to establish, by its own controlled translation movement, a forward or backward "perturbation", relative to the constant movement of the flexible support 4, and thus a relative position change between the flexible support 4 and the printing cylinder 3. Such position change, which is typically small, is controlled by the system 1 in a very accurate manner, as it will be better illustrated herein below, in order to correct and compensate for possible shifts detected between the zones to be overprinted of the flexible support 4 and the printing zones of the printing cylinder 3.

In a different manner, but with equivalent effects, the winding compensator 18 is suitable to determine said relative position change between the flexible support 4 and the printing cylinder 3 exerting a forward or backward "perturbation", to the movement of the flexible support 4, through a controlled change of the rotation thereof.

Furthermore, the second actuation means 20 comprise a compensating motor module 19, operatively connected to the compensating roll 18 (or to the winding compensator 18), to drive a hasting or deferring movement thereof, which is controlled with an accuracy that is comparable to the accuracy that it is desired to achieve on the position change of the flexible support 4. The compensating motor module 19 is, in turn, connected to the control means 10 of the system 1, which drive it so that it operates in a controlled manner with the required accuracy.

With reference to the important aspects relative to the control the system 1 operation, it is noticed that the overprinting action, which is made possible by the system 1, occurs when a preset zone to be overprinted, in the flexible support 4, is in contact with a corresponding printing zone of the printing cylinder 3. In order for the system to act in a rapid and accurate manner, it is crucial that at each moment there is a very accurate spatial correspondence between the above-mentioned preset zone to be overprinted and the corresponding printing zone.

Since the system operates on a flexible support 4 that, as already described, moves along an unwinding path, the above-illustrated requirement of a spatial correspondence mirrors in a corresponding requirement of accurate control, moment by moment, of the flexible support movement relative to the printing cylinder position and movement. To such purpose, as already described above, the system of the invention provides for controlling in an accurate manner, by the control means 10, both the flexible support 4 movement, and the printing cylinder 3 rotational movement, and the coordination thereof.

Although, in principle, a certain coordination degree between the above-mentioned movements, thus an adjustment level of possible shifts, may be obtained by action on a single one of the two variables (i.e., only on a single one of the two movements), the ability of the present system to act and control both variables (i.e., both movements) allows obtaining a better coordination, thereby causing a quicker correction of the phase shifts. Consequently, the overprint precision is always maintained at high levels, and in any event it is recovered to satisfactory levels in very quick times.

The double control action that is performed by the present system may determine, for example, an advantageous cooperation and complementarity of effects. In fact, an overall repositioning of the flexible support, which is important in view of a re-adjustment of the operative regime conditions of the system, may be advantageously obtained by controlling the flexible support movement; however, this is reflected in a delay of the effective overprint correction, which delay is comparable to the time the flexible support takes to run the length between the point where the adjustment acts and the printing cylinder 3. In order to obtain an immediate re-phasing, at the printing unit 2, therefore, one may advantageously act on the rotational speed of the printing cylinder 3, which immediately results in a change of the relative position of the cylinder printing zone with respect to the preset zone to be overprinted of the flexible support part that is already in the proximity of the printing cylinder. Subsequently, when the flexible support part that has already undergone an upstream adjustment reaches the printing cylinder 3, the printing cylinder 3 rotational speed may be brought back to its nominal value.

In order to further illustrate what has been set forth above, it shall be noticed that, typically, the reels to be overprinted come directly from the users (or the manufacturers), and in average have a length between 800 and 1000 linear meters. After a whole reel with such length in meters has been unwrapped and treated, the machine is stopped, a new reel has to be pitch joined, and then the machine is restarted. This inevitably causes a production waste (out-of-register), which however is reduced by 50% or even by 60%, when the above-described double control action is carried out, relative to the case in which such control action is not carried out.

Taking now into consideration in more detail the control means 10 of the system 1, it shall be noticed that, according to an implementation example, they may comprise a phase shift detection device 12, 13 configured to detect a phase shift between the preset zones to be overprinted of the flexible support 4 and the respective printing zones of the printing cylinder 3. The control means 10 further comprise a processing unit 11, operatively connected to the detection device 12, 13 to receive phase shift indicating signals, indicative of said phase shift. The processing unit 11 is configured to generate first control signals for the first actuating means (14 or 15 or 16) and second control signals for the second actuation means 20, based on the received phase shift indicating signals. The first actuating means (14 or 15 or 16) and the second actuation means 20 (in particular, the compensating motor module 19) are operatively connected to the processing unit 11 to receive the first and second control signals, respectively. Based on such control signals, the first and the second actuation means respectively control the printing cylinder 3 movement and the flexible support 4 movement.

The processing unit 11 may comprise one or more electronic processors, per se known, in which software programs can be stored, which implement control algorithms for generating control signals that are suitable to manage (for example, in the manner illustrated above) the movements of the flexible support 4 and of the printing cylinder 3 and the coordination thereof.

In accordance with an implementation example, the flexible support 4 comprises recognition marks, at the preset zones to be overprinted.

In addition, the detection device of the control means 10 comprises a reading element (i.e., reading head) 12, which is configured to read the recognition marks arranged at the preset zones to be overprinted. In a particular implementation example, the reading element 12 is arranged along the unwinding path, downstream of the compensating roll 18 and upstream of the printing unit 2 (i.e., of the printing cylinder 3).

The detection device further comprises a sensor 13, arranged in the proximity of the printing cylinder 3 and configured to detect the transit frequency of the printing zones of the printing cylinder.

In such a case, the above-mentioned phase shift indicating signals are signals generated by the reading element 12 and the sensor 13, which signals are sent to the processing unit 11, giving it sufficient basic information, from which the processing unit 11 is capable of determining the possible movement corrections to be imposed to the first and the second actuation means of the flexible support 4 and of the printing cylinder 3, respectively, and of generating the respective first and second control signals.

In particular, the reading element 12 detects the passage of the recognition marks arranged at each zone to be overprinted, and controls, in cooperation with the sensor 13, the matching of the latter with the corresponding printing zone of the printing cylinder 3. If, in such passage, even minimal advances or delays, relative to the preset precise moment, are detected on the basis of the detection by the sensors 12 and 13, for example due to a variations of the cut pitch or to accidental sliding movements of the flexible support 4, the processing unit 11 consequently emits appropriate control signals for the first and the second actuation means.

Therefore, in brief, such control signals, properly generated by the processing unit 11, based on the detections performed by the detection device 12, 13, give rise to a simultaneous intervention of the compensating motor module 19 and of the first motor unit comprised in the first actuating means (14 or 15 or 16).

At this point, it shall be noticed that all the elements described above, except for the printing unit 2, and the selection among the functionally equivalent elements "compensating roll 18" or "winding compensator 18", are exactly the same for the three different embodiments of the system, illustrated in the FIGS. 1, 2, 3 (each embodiment being also developable, as regards some possible options for the single elements of the system, as in the various implementation examples described above).

From this aspect, an important characteristic of the invention stems: according to an implementation example of the invention, in fact, the system 1 is a configurable overprint machine 1, suitable to operate with different types of printing units 2, and wherein each of the at least one printing unit 2 can be replaced by a respective printing unit of a different type. For example, each of such at least one printing unit 2 may be a rotogravure printing unit, or a flexographic printing unit, or a relief printing unit.

In accordance with a first embodiment of the system 1, illustrated in the FIGS. 1 and 2, the printing unit 2 of the system 1 is a relief printing unit, suitable to produce tridimensional reliefs on the flexible support 4.

According to an implementation example, such tridimensional reliefs correspond to Braille alphabet writings.

In such case, the printing cylinder 3 is provided, in the printing zones, with tridimensional printing relief parts 30, so configured as to produce a desired type of tridimensional relief on the flexible support.

Furthermore, according to an implementation example, illustrated in FIG. 1, the first actuating means 14 of the printing unit 2 comprise an actuator 14 of the "harmonic drive" type, per se known, and the effectiveness of which in the considered application field is known. In such case, the second actuation means 20 comprise a winding compensator 18.

In accordance with an alternative implementation example, illustrated in FIG. 2, the first actuating means 15 comprise a gearless-type motor 15, per se known, the effectiveness of which in the considered application field is also known. Preferably, such gearless motor 15 is mounted axially to a cylinder-bearing shaft, which axially supports the printing cylinder 3, thereby dictating in a controlled manner the printing cylinder 3 rotation about such axis. For this reason, the gearless motor is indicated by an hatched line, in FIG. 2, since it lies in a plane different from the cross-sectional one. In such case, the second actuation means 20 comprise a winding compensator 18, for example a motorized calender configured to vary its own rotational speed, upon a command of the compensating motor module 19, and in this manner to transmit the appropriate advancing or deferring movement to the flexible support 4.

An optimal use of the two different implementation options, mentioned above, provides for the use of the "Harmonic Drive" option, together with the compensating roll 18, for overprinting on flexible supports of materials with high thicknesses, such as, for example tripe-layer materials, paper, "Tetra Pak®" type materials; and, on the other hand, the use of the "Gearless" option, together with the winding compensator 18, for flexible supports in monomaterials having a reduced thickness.

In accordance with a further embodiment of the system 1, the printing unit 2 of the system 1 is a printing unit of the rotogravure type, suitable to impress rotogravure prints on the flexible support 4.

Such embodiment, and the relative implementation examples with harmonic drive or gearless motor, is very similar to the first embodiment, described above in the FIGS. 1 and 2, which are referred to for any aspects, except in that the printing cylinder 3 is a rotogravure print cylinder, without relief parts.

In accordance with a further embodiment of the system 1, illustrated in FIG. 3, in the system 1, the printing unit 2 is a flexographic type printing unit, suitable to impress stamps with flexographic techniques on the flexible support 4.

In such case, according to solutions per se known in the flexographic print field, the printing cylinder 3 is a printing plate (i.e., "cliché-holder") cylinder 3. Furthermore, the printing unit 2 further comprises a countercylinder (i.e., impression cylinder) 17 and an anilox cylinder 25. In that case, the flexible support 4 passes between the printing plate cylinder 3 and the countercylinder 17, in order to be overprinted.

In addition, according to an implementation example, the first actuating means of the printing unit 2 comprise in this case an actuator 16 of the brushless type, per se known, which effectiveness in the considered application field is known. Such brushless actuator 16 is suitable to drive the operation of the printing plate cylinder 3. In such case, as illustrated in FIG. 3, the second actuation means 20 comprise a winding compensator 18.

Herein below, an overprint method according to the invention will be described, which may be carried out by the overprint system 1 according to the invention, in the several embodiments described above.

In particular, a method for overprinting on flexible supports, having preset zones to be overprinted, is described, wherein such method comprises the steps of: unwinding a flexible support 4 from a first unwinding reel 5 to a second rewinding reel 8, through an unwinding path passing through a printing unit 2 comprising at least one rotatable printing cylinder 3, having printing zones at the surface thereof; then, overprinting the preset zones to be overprinted of the flexible support 4 by means of a contact with corresponding printing zones of the printing cylinder 3, upon the passage of the flexible support 4 in the printing unit 2.

In the method, the above-mentioned step of unwinding a flexible support comprises driving in a controllable manner the advancement of the flexible support 4 along the unwinding path, upstream of the printing unit (2) in the unwinding direction, by second actuation means 20.

The above-mentioned overprinting step comprises driving in a controllable manner the rotation of the printing cylinder 3, by first actuating means (14 or 15 or 16).

Furthermore, the above-mentioned actions of driving the flexible support advancement and driving the printing cylinder rotation comprise controlling in a coordinated manner, by control means 10, both the first actuating means (14 or 15 or 16) and the second actuation means 20, so as to determine at every moment a correspondence of the preset zones to be overprinted of the flexible support 4 with respective printing zones of the printing cylinder 3.

According to a particular implementation example of the method, the flexible support 4 contains a set of configurations and/or writings with a periodic sequence that have to be modified in a controllable manner at the preset zones to be overprinted, so that recycling the flexible support is allowed.

In accordance with a particular implementation example of the method, the step of controlling the first and second actuation means comprises the sub-steps of: detecting, by a phase shift detection device 12, 13, a phase shift between the preset zones to be overprinted of the flexible support 4 and the respective printing zones of the printing cylinder 3, to generate respective phase shift indicating signals; then processing, by a processing unit 11, such phase shift indicating signals, to generate first control signals for the first actuating means and second control signals for the second actuation means, based on the received phase shift indicating signals; finally, providing the first control signals to the first actuating means (14 or 15 or 16) and the second control signals to the second actuation means 20, so as to drive in a controlled and coordinated manner the printing cylinder 3 rotation and the flexible support 4 advancement, respectively.

According to other particular implementation examples of the method, the steps of the method are carried out by means of an overprint system 1 according to any of the embodiments and the implementation examples already described before.

As it can be noticed, the object of the present invention is achieved by the system and the method described above.

In fact, based on what has been set forth above, it is clear that the system according to the invention is capable, by virtue of its own characteristics, to make possible carrying out an overprint on a flexible support through different printing techniques, among which a relief printing, in a very precise, rapid, and inexpensive manner, so as to meet the needs set forth at the beginning of the present specification.

In particular, the simultaneous control of the movements of both the printing cylinder 3 and the flexible support 4 allows to precisely and almost instantaneously correct even minimal phase shift which may occur, relative to a mutual nominal position between the flexible support and the printing cylinder, which allows an optimal printing. Consequently, the overprinting precision is always maintained at high levels, and it is anyhow recovered to satisfactory levels in very quick times.

From this, it also follows that, by means of the system of the invention, it is possible to carry out a relief overprint, which is instead impossible in the prior art solutions, that are not capable of ensuring the same level of precision and rapidity when correcting phase shifts.

Furthermore, the architecture of the described system is such as to make it configurable, this meaning that it may operate with different printing units, while keeping the other elements/modules of the machine unaltered. This provides advantages in terms of cost-effectiveness and use versatility.

From the technical advantages listed above, other more general advantages originate, relating to the significant extension of the application field of overprinting, leading to consequent advantages relating to the recycle possibilities, in terms of cost-effectiveness, environmental preservation, and energy saving.

To the embodiments of the system and the overprint method according to the invention, described above, those of ordinary skill in the art, in order to meet contingent needs, will be able to make modifications, adaptations, and replacements of elements with functionally equivalent other ones, also in combination with the prior art, also creating hybrid implementations, without departing from the scope of the following claims. Each of the characteristics described as belonging to a possible embodiment may be carried out independently from the other embodiments described.

It is further noticed that the term "comprising" does not exclude other elements or steps, the term "a" or "one" does not exclude a plurality. Furthermore, the figures are not necessarily in scale; on the contrary, importance is general given to illustrate the principles of the present invention.

What is claimed is:

1. An overprint system for overprinting on flexible supports, comprising:

at least one printing unit comprising at least one rotatable printing cylinder, having printing zones at the surface thereof, said at least one printing unit further comprising first actuating means, configured to drive in a controllable manner the rotation of the printing cylinder;

at least one first reel for unwinding a flexible support to be printed, wherein said flexible support has preset zones to be overprinted;

at least one second reel for re-winding said flexible support, once it has been printed;

a plurality of winding rolls configured to arrange an unwinding path for said flexible support, the unwinding path being comprised between said first and said second reels, and passing through said printing unit;

second actuation means, configured to drive in a controllable manner the advancement of the flexible support along the unwinding path, upstream of the printing unit in the unwinding direction; and control means configured to control in a coordinated manner both the first actuating means and the second actuation means, so as to determine at every moment a correspondence of the preset zones to be overprinted of the flexible support with respective printing zones of the printing cylinder, wherein the control means are configured to control, in a coordinated manner and simultaneously, both the first actuating means to change the rotation speed of the printing cylinder, and the second actuating means to change the speed of the advancement of the flexible support, so that the change of the rotation speed of the printing cylinder and the change of the speed of the advancement of the flexible support occur simultaneously and in a coordinated manner, to compensate for relative position shifts between the preset zones to be overprinted of the flexible support and the respective printing zones of the printing cylinder.

2. The system according to claim 1, wherein the system is a configurable overprint machine, suitable to operate with different types of printing units, and wherein each of the at least one printing unit can be replaced by a respective printing unit of a different type.

3. The system according to claim 1, wherein each of said at least one printing unit is a rotogravure printing unit, or a flexographic printing unit, or a relief printing unit.

4. The system according to claim 3, wherein the printing unit is a relief printing unit, suitable to produce tridimensional reliefs on the flexible support.

5. The system according to claim 4, wherein said tridimensional reliefs correspond to Braille alphabet writings.

6. The system according to claim 4, wherein the printing cylinder of the printing unit is provided with tridimensional printing relief parts and wherein the first actuating means of the printing unit comprise a harmonic drive type actuator or a gearless type actuator.

7. The system according to claim 3, wherein the printing unit is a printing unit of the rotogravure type, and wherein the first actuating means of the printing unit comprise a harmonic drive type actuator or a gearless type actuator.

8. The system according to claim 3, wherein the printing unit is a flexographic type printing unit, and wherein the first actuating means of the printing unit comprise a brushless motor type actuator.

9. The system according to claim 1, wherein the control means comprise:

a phase shift detection device configured to detect a phase shift between the preset zones to be overprinted of the flexible support and the respective printing zones of the printing cylinder;

a processing unit, operatively connected to said detection device to receive phase shift indicating signals, indicative of said phase shift, and configured to generate first control signals for the first actuating means and second control signals for the second actuation means, based on said received phase shift indicating signals;

and wherein the first actuating means and the second actuation means are operatively connected to said processing unit to receive said first and second control signals, respectively.

10. The system according to claim 9, wherein the flexible support comprises recognition marks, at said preset zones to be overprinted, and wherein the detection device comprises:

a reading element arranged along said unwinding path, configured to read said recognition marks;

a sensor arranged in the proximity of the printing cylinder, said sensor being configured to detect the transit frequency of the minting zones of the printing cylinder.

11. The system according to claim 1, wherein the second actuation means comprise a compensating roll, arranged upstream of the printing unit along the unwinding path, and configured to move by translation in a controlled manner, such as to move forward or backward in a controlled manner the position of the flexible support relative to the printing cylinder.

12. The system according to claim 1, wherein the second actuation means comprise a winding compensator, arranged upstream of the printing unit along the unwinding path, and configured to rotate at a variable speed in a controlled manner, such as to move forward or backward in a controlled manner the flexible support position relative to the printing cylinder.

13. The system according to claim 11, wherein the second actuation means further comprise a compensating motor module, operatively connected to a winding compensator, or with the compensating roll, to actuate the movement thereof in a controlled manner.

14. The system according to claim 1, further comprising:

a first support member, suitable to support the first reel;

a second support member, suitable to support the second reel;

a nip roll, arranged in the printing unit on the unwinding path in the proximity of the printing cylinder, said nip roll being suitable to increase the contact pressure between the flexible support and the printing cylinder.

15. The system according to claim 1, wherein the flexible support is a continuous ribbon-shaped strip that has a sequence of zones corresponding to respective labels or packages to be printed or overprinted in series, in an equal manner.

16. The system according to claim 1, wherein the preset zones to be overprinted of the flexible support are zones of labels or packages that have been pre-printed, which have to be modified in a controlled manner to get new labels or packages, so as to allow recycling the flexible support.

17. A method for overprinting on flexible supports, which have preset zones to be overprinted, comprising:

unwinding a flexible support from a first unwinding reel to a second rewinding reel through an unwinding path passing through a printing unit comprising at least one rotatable printing cylinder, having printing zones at the surface thereof;

overprinting said preset zones to be overprinted of the flexible support by means of a contact with corresponding said printing zones of the printing cylinder, upon the passage of the flexible support in the printing unit;

wherein the unwinding operation comprises driving in a controllable manner the flexible support advancement along the unwinding path, upstream of the printing unit in the unwinding direction, by second actuation means, and the overprinting operation comprises driving in a controllable manner the printing cylinder rotation, by first actuating means;

and wherein the operations of driving in a controllable manner the flexible support advancement and driving in a controllable manner the printing cylinder rotation comprise controlling in a coordinated manner, by control means, both the first actuating means and the second actuation means, so as to determine at every moment a correspondence of the preset zones to be overprinted of the flexible support with respective printing zones of the printing cylinder, and wherein the operation of controlling in a coordinated manner, by control means, the first actuating means and the second actuating means comprises changing the rotation speed of the printing cylinder, through the first actuating means, and changing the speed of the advancement of the flexible support through the second actuating means, to compensate for relative position shifts between the preset zones to be overprinted of the flexible support and the respective printing zones of the printing cylinder, wherein changing the rotation speed of the printing cylinder and changing the speed of the advancement of the flexible support occur simultaneously and in a coordinated manner by the control means.

18. The method according to claim 17, wherein the flexible support contains a set of configurations and/or writings with a periodic sequence that have to be modified in a controllable manner at said preset zones to be overprinted, so as to allow the recycle of the flexible support.

19. The method according to claim 17, wherein the operation of controlling the first and the second actuation means comprise:

detecting, by a phase shift detection device, a phase shift between the preset zones to be overprinted of the flexible support and the respective printing zones of the printing cylinder, to generate respective phase shift indicating signals;

processing, by a processing unit, the phase shift indicating signals, to generate first control signals for the first actuating means and second control signals for the second actuation means, based on said received phase shift indicating signals;

providing the first control signals to the first actuating means and the second control signals to the second actuation means, so as to drive in a controlled and coordinated manner the printing cylinder rotation and the flexible support advancement, respectively.

* * * * *